US006945399B1

(12) United States Patent
Ong

(10) Patent No.: US 6,945,399 B1
(45) Date of Patent: Sep. 20, 2005

(54) EXPANDING FILE WITH REMOVABLE TOTE BOX

(76) Inventor: Bon S. Ong, Box 4247, Torrance, CA (US) 90510

( * ) Notice: Subject to any disclaimer, the term of this patent is extended or adjusted under 35 U.S.C. 154(b) by 100 days.

(21) Appl. No.: 10/643,851

(22) Filed: Aug. 20, 2003

(51) Int. Cl.[7] ..... B65D 85/00
(52) U.S. Cl. ..... 206/425; 229/67.3; 229/67.4
(58) Field of Search ..... 206/425; 150/106, 150/113, 118; 190/110, 111; 229/67.1, 67.3, 229/67.4, 72; 402/73

(56) References Cited

U.S. PATENT DOCUMENTS

| | | | | |
|---|---|---|---|---|
| 1,940,900 | A | 12/1933 | Bernard | |
| 2,151,469 | A | 3/1939 | Hochtheil | |
| 2,316,328 | A | 4/1943 | Guenther | |
| 2,612,199 | A | 9/1952 | Schocket | |
| 2,893,457 | A | 7/1959 | Wilson | |
| 5,664,724 | A | 9/1997 | Ho | |
| 5,806,754 | A * | 9/1998 | Boyle | 229/67.3 |
| 6,502,742 | B1 | 1/2003 | Su | |
| 6,558,063 | B2 * | 5/2003 | Ho | 206/425 |
| 6,607,122 | B1 * | 8/2003 | Ong | 229/67.3 |
| 6,669,080 | B2 * | 12/2003 | Ong | 229/67.3 |
| 6,796,428 | B1 * | 9/2004 | Ong | 206/425 |
| 6,880,747 | B1 * | 4/2005 | Pelleg | 206/425 |

* cited by examiner

*Primary Examiner*—Luan K. Bui
(74) *Attorney, Agent, or Firm*—Charles H. Thomas

(57) ABSTRACT

A portable filing case is provided with a stiff back, bottom, front, top, and foldable cover flap and is delineated into a rear compartment and an expandable front compartment by an upright compartment demarcation panel. The rear compartment is provided with a pair of flexible fabric rear side panels that extend between the file case back and the compartment divider panel. A pair of front compartment side panels are folded from top to bottom with a plurality of accordion folds that extend between the compartment divider panel and the front file cover. A plurality of file section dividers are individually secured to the expandable compartment side panels at separate ones of the accordion folds. A stiff-walled rectilinear tote box may be inserted snugly into the rear compartment to accommodate bulky items, such as thick catalogs and other relatively large articles. The file section dividers divide the front compartment into a plurality of filing pockets. The front filing compartment is expandable by pulling the upper edge of the front compartment front panel forwardly to fan the front compartment divider sheets apart. Alternatively, the front filing compartment may be compressed by pushing the upper edge of the front compartment front panel back toward the compartment demarcation panel, whereupon the foldable flap may be pulled over the top of both compartments and secured to the front compartment front panel by mutually interengageable clasp elements.

16 Claims, 12 Drawing Sheets

EXPANDING FILE WITH REMOVABLE TOTE BOX

BACKGROUND OF THE INVENTION

1. Field of the Invention

The present invention is an expanding file with a removable tote box for use in carrying documents in an organized manner within a filing compartment, and also larger articles in a compartment separate from the divided filing compartment.

2. Description of the Prior Art

Briefcases with expandable files constructed in them have been utilized for many years. However, conventional briefcases with expanding files typically lack the capability of carrying larger, bulky documents or nondocument items in an organized manner. As a consequence, if larger documents are carried within the compartment of a briefcase, they will sometimes tumble about and damage papers stored in the expanding file located within the briefcase.

SUMMARY OF THE INVENTION

It is an object of the present invention to provide a portable filing case which is able to accommodate not only paper documents organized in collapsible document pockets defined between filing folder file section dividers, but also larger, bulkier documents and other articles that will not conveniently fit into the document storage pockets in the expandable file. Furthermore, these larger items may be carried in a manner so as not to damage the expandable file, or the documents stored in the expandable file. This is achieved by providing the filing case with a removable tote box that fits into a dedicated compartment distinct and separated from the document filing compartment within the case.

The filing case of the invention is constructed as a unitary structure having two distinct compartments delineated by a transversely extending, stiff demarcation panel. The demarcation panel serves as a separator to isolate a rear storage compartment for relatively large articles from a front compartment containing filing folder file pockets in an expandable file. Moreover, a tote box is provided so that all of the larger, bulkier articles can be lifted together out of the portable storage compartment in which they are carried.

Furthermore, the filing case of the invention is extremely versatile since it may be utilized with or without the tote box. The side walls of the tote box compartment are formed of a flexible material. When the tote box is inserted into the compartment in the case in which it is designed to fit, it stretches the side walls so that the tote box compartment conforms to the shape of the tote box. With the tote box in place the tote box compartment has a rectilinear configuration of specific shape. When the tote box is removed, however, the flexible walls of the tote box compartment can be collapsed to provide additional room within the filing case to accommodate expansion of the expandable file in a rearward direction and into the space vacated by the tote box. The user is thereby able to use the filing case of the invention in different ways at different times for the transportation of different types of materials.

The filing case of the invention has a foldable closure flap that extends over the top of the filing structure and which is equipped with a clasp element engageable with a mating clasp element located on a panel of the filing case opposite the panel at which the closure flap is hinged. The panel to which the closure flap is engaged by the clasp elements may be considered to be the front of the filing case, while the panel to which the foldable flap is hinged may be considered to be the rear cover or wall. Employing this convention the filing case is divided into a front compartment having a plurality of file section dividers that delineate a plurality of transversely extending pockets for documents, and a rear compartment that accommodates the insertion and removal of the stiff-walled tote box.

In one broad aspect the present invention may be considered to be a filing case comprising a filing pouch, a stiff tote box, and an expandable filing folder. The filing pouch has a stiff compartment demarcation panel and a stiff pouch back cover. Both the compartment demarcation panel and the back cover have upper and lower edges. The compartment demarcation panel is located in front of the pouch back cover. A stiff folding flap is joined to the upper edge of the pouch back cover in articulated fashion. A pair of flexible pouch side panels have upper and lower edges and are each attached to the compartment demarcation panel and the pouch back panel cover from the upper to the lower edges thereof. A stiff pouch bottom panel extends transversely between the pouch side panels and between the compartment demarcation panel and the pouch back cover. The filing pouch thereby forms a pouch compartment between the compartment demarcation panel, the pouch back cover, the pair of pouch side panels, and the pouch bottom panel.

The stiff tote box has fixed dimensions and is formed with a back panel, a front panel, a bottom panel, and opposing side panels. The tote box fits snugly into the pouch compartment. The tote box is alternatively removable from the pouch compartment and insertable into the pouch compartment to contact the pouch back cover, the compartment demarcation panel, the bottom panel, and the pouch side panels.

The expandable filing folder has a filing folder front cover having a top and bottom with a first clasp member thereon. The compartment demarcation panel forms a back for the expandable filing folder. The filing folder has a plurality of filing folder file section dividers having opposing, mutually parallel filing folder divider upper and lower edges and opposing, mutually parallel, filing folder divider side edges oriented perpendicular to the filing folder divider upper and lower edges. The filing folder file section dividers are coupled to the filing folder front cover and the compartment demarcation panel with a plurality of accordion fold pleated connections. A plurality of filing folder file pockets are thereby formed between the filing folder file section dividers and the filing folder front cover and the compartment demarcation panel.

The folding flap has a second clasp member thereon. The folding flap is foldable over the filing folder front cover and over the expandable filing folder to both close the pouch compartment and envelop the filing folder between the folding flap and the pouch back cover, whereupon the first and second clasp members are engageable with each other. This may be accomplished both when the tote box is inserted into the pouch compartment and when the tote box is removed therefrom. The folding flap is unfoldable to expose both the pouch compartment and the expandable filing folder.

In another broad aspect the invention may be considered to be a filing case having a rear compartment and an expandable front compartment with a stiff compartment demarcation panel having a lower edge located therebetween. A plurality of file section dividers are located in the expandable front compartment to divide the expandable front compartment into separate pockets between the file section dividers. The file section dividers have side edge margins. A pair of front compartment side panels are folded from top to bottom with a plurality of accordion folds. The side edge margins of the file section dividers are individually secured to the side panels at separate ones of the accordion folds. The front compartment is thereby collapsible front to back.

The rear compartment is formed by a stiff back wall located behind the compartment demarcation panel. The rear compartment has flexible sidewalls extending from the back wall to the compartment demarcation panel. The rear compartment is configured as a cavity located between the compartment demarcation panel, the back panel, and the rear compartment sidewalls, and closed by a bottom.

A stiff, rectilinear tote box is removably insertable into the rear compartment to fit snugly between the back wall, the compartment demarcation panel, and the rear compartment sidewalls in contact therewith.

A releaseable folding cover flap projects upwardly from the back wall and is foldable forwardly to extend over both the front and rear compartments. Releaseable, mutually engageable clasp elements are provided on the folding cover flap and on the front panel of the front compartment.

In still another aspect the invention may be described as a filing case comprising: a stiff flat base structure, a pair of flexible rear compartment side panels, a stiff rectilinear tote box, a transversely oriented stiff compartment demarcation panel, a pair of front compartment side panels, and a plurality of transversely front compartment divider sheets. The stiff, flat base structure is divided transversely by folds to define articulated components including a front compartment front panel having opposing side edges and a first catch element thereon, a bottom, a back wall, and a top cover closure flap having a second clasp element thereon. These articulated components are joined together by transverse hinged connections. The flexible rear compartment side panels extend forwardly from the back wall and are located atop the bottom. The compartment demarcation panel is located in front of the back wall and above the bottom and extends between and is joined to the rear compartment side panels. The compartment demarcation panel has opposing side edges joined to the rear compartment side panels. The demarcation panel delineates a rear compartment from a front compartment.

A stiff, rectilinear tote box is provided to snugly fit into the rear compartment and is removable therefrom. The pair of front compartment side panels are folded from top to bottom with a plurality of accordion folds and are secured from top to bottom to the opposing side edges of the compartment demarcation panel. The front compartment side panels are also secured from top to bottom to the opposing side edges of the front compartment front panel. The transverse front compartment divider sheets have side edge margins that are individually secured to separate ones of the accordion folds in the front compartment side panels. This construction defines a plurality of transversely extending pockets in the front compartment closed from beneath by the bottom.

The front compartment is compressible by rotation of the front compartment front panel relative to the bottom and toward the compartment demarcation panel. It is expandable by rotation of the front compartment front panel relative to the bottom away from the compartment demarcation panel. When the clasp elements are disengaged the cover flap may be closed and the clasp elements engaged together when the front compartment is collapsed with or without the tote box in the rear compartment.

Preferably releaseable fastening members are provided for holding the tote box in the rear compartment when it is used therein. These releaseable fastening members may, for example, be mating pads of flexible, fabric hook and loop fastener material of the type sold under the registered trademark Velcro®.

Preferably also, the filing case of the invention is provided with at least one hanging pocket permanently secured inside the tote box near the upper extremity thereof. This hanging pocket is ideally configured in size and shape to snugly accommodate a portable computer disk, such as a floppy disk or a computer CD disk.

Also, at least one transparent window pocket may be formed into the expandable filing folder on the surface of the compartment demarcation panel that faces the filing folder front cover.

Another feature of the preferred embodiment of the invention resides in the manner in which the filing folder section dividers are attached to the filing folder side panel sheets. Preferably, both the filing folder section dividers and the filing folder side panel sheets are formed of plastic sheets and the filing folder section dividers have side edge margins. The side edge margins are separately heat welded to separate ones of the accordion folds in the filing folder side panel sheets.

While the attachment of each side edge margin of each filing folder section divider to the side panel sheets is separate, all of the heat welds of the side edge margins to the side panel sheets can be performed simultaneously. This is accomplished by positioning spacer bars between each of the filing folder file section dividers and bending the side edge margins thereon toward the ends of the spacer bars prior to creating the accordion folds in the filing folder side panel sheets. The filing folder side panel sheets, while still flat, are pressed toward the side edge margins of the filing folder file section dividers by metal heat welding pressure plates oriented perpendicular to the spacing bars from both ends of the filing folder file section dividers, thereby pressing the side edge margins of the section dividers into face-to-face contact with the filing folder side panel sheets, but at spaced intervals from each other. Electrical heating current is then applied to linear locations along either the spacing bars or the pressure plates to create linear heat welds at the locations of contact between each of the side edge margins of the section dividers and the filing folder side panel sheets.

The plastic resiliency or "memory" of the file section dividers causes the side edge margins of the file section dividers to straighten out somewhat once the pressure plates are withdrawn, thereby causing the side panel sheets to assume a wavy or "zigzag" shape. The spacer bars can then be removed and the side panels collapsed by pleating plates oriented perpendicular to the heat welding pressure plates. The compression of the side panel sheets with edge margins of the section dividers attached thereto in this manner creates the plurality of accordion folds in the side panel sheets.

The invention may be described with greater clarity and particularity by reference to the accompanying drawings.

DESCRIPTION OF THE EMBODIMENT

Figure 7:
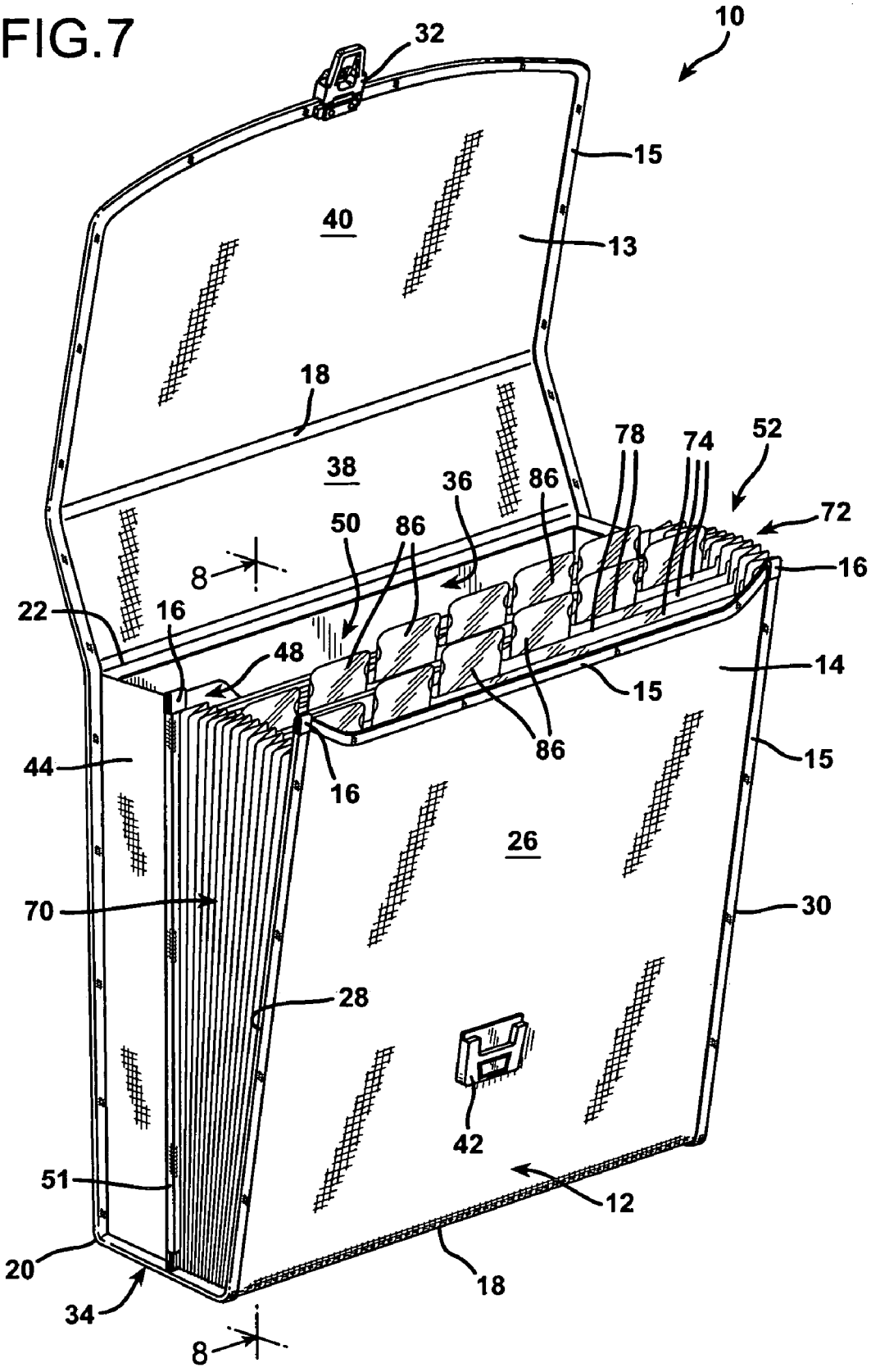
FIG. 7 is a perspective view thereof with the foldable flap shown in the open condition and with the filing folder partially expanded.
Figure 9:
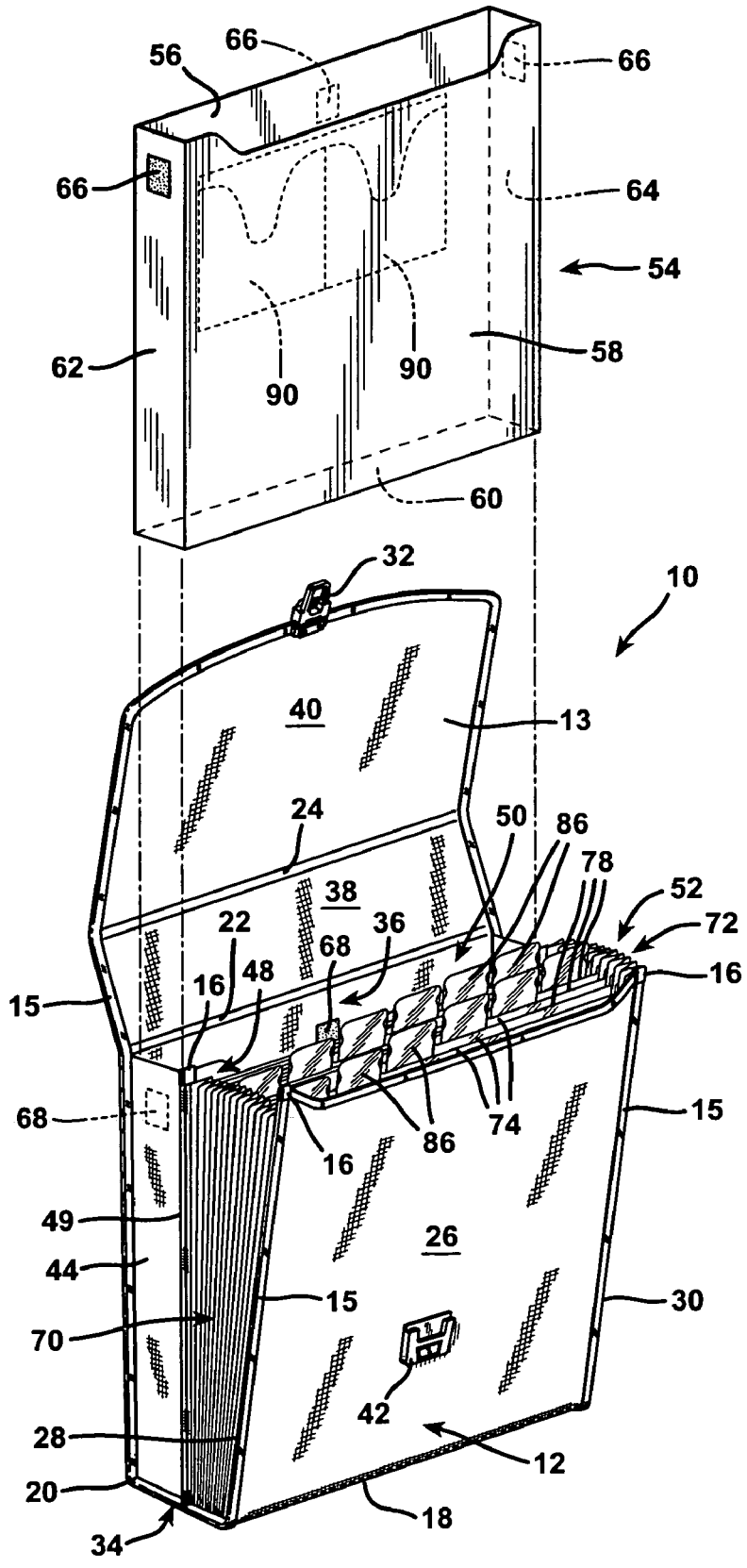
FIG. 9 is a perspective view thereof shown with the tote box removed.

FIGS. 1–6 illustrate a filing case 10 constructed according to the present invention illustrated in a closed condition. The filing case 10 is comprised of a stiff, flat base structure 12 that may be formed of a stiff plastic sheet 13 of polyethylene or polypropylene covered on the outside with a fabric layer 14. The plastic sheet 13 underlying fabric layer 14 is not visible when the filing case 10 is closed, as shown in FIGS. 1–6, but is visible when the filing case 10 is opened, as illustrated in FIGS. 7 and 9.

The fabric layer 14 is secured to the stiff plastic sheet 13 therebeneath by means of a fabric trim 15 wrapped over the edges of the fabric layer 14 and the plastic sheet 13 that is in face-to-face contact therewith. The fabric trim 15 is sewn with thread or secured by adhesive to the underlying sheet of plastic 13 that serves as a stiffening core of the base structure 12. Metal corner clips 16 are clamped onto the fabric trim 15 and secured to the underlying stiff plastic sheet 13 of the base structure 12. The metal corner clips 16 serve to reinforce the exposed corners of the filing case 10 that are subject to the greatest stress that would tend to separate the trim 15 and fabric layer 14 from the underlying plastic sheet 13.

The base structure 12 is divided transversely by transverse linear folds 18, 20, 22, and 24 to define articulated components of the base structure 12. These components include a front compartment front panel 26 having opposing side edges 28 and 30, a rectangular bottom 34, a rectangular back wall 36, a rectangular top 38, and a cover closure flap 40. The articulated components 26, 34, 36, 38, and 40 are joined together by the transverse hinge connections 18, 20, 22, and 24, respectively. The front panel 26 has a first clasp element 32 thereon, while the cover closure flap 40 has a second clasp element 42 thereon.

The filing case 10 has a pair of flexible fabric rear compartment side panels 44 and 46 extending forwardly from the back wall 36. The fabric rear compartment side panels 44 and 46 are located atop the stiff bottom 34 of the base structure 12, but are not connected directly to it.

Figure 10:
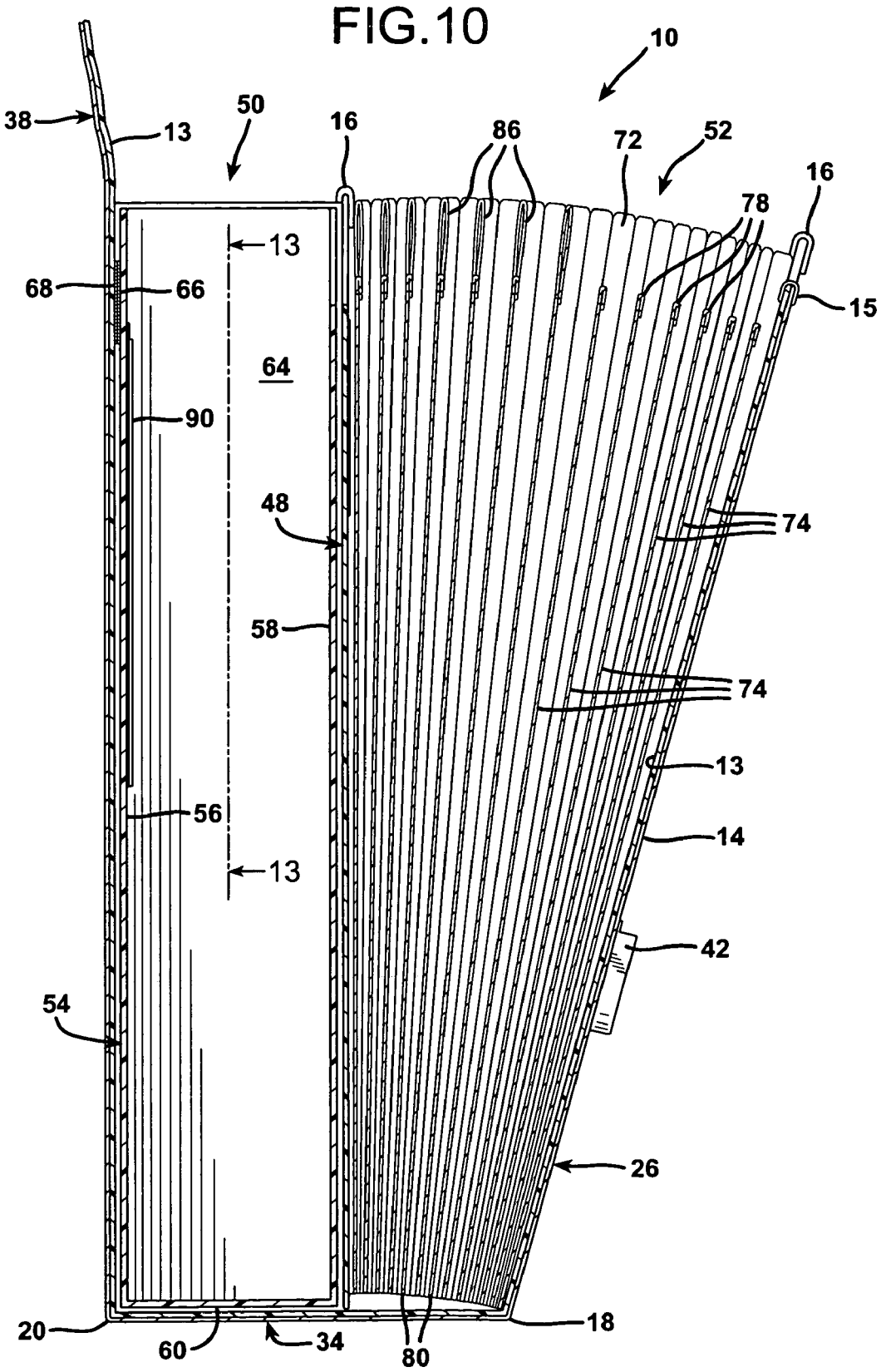
FIG. 10 is a side sectional elevational view thereof shown with the tote box inserted into the rear compartment of the filing case.

As illustrated in FIGS. 7–11 a transversely oriented stiff plastic compartment demarcation panel 48 is located in front of the back wall 36, behind the front panel 26, and above the bottom 34. The compartment demarcation panel 48 extends between and is joined to the rear compartment side panels 44 and 46 by the fabric trim 15, but is not directly fastened to the bottom 34. Both the fabric side panels 44 and 46 and the stiff plastic compartment demarcation panel 48 have edge margins which meet in face-to-face relationship so that they can be sewn together by stitching through the fabric trim 15. The compartment demarcation panel 48 thereby delineates a rear compartment 50 from a front compartment 52, as best illustrated in FIGS. 9 and 10.

A stiff, rectilinear tote box 54, formed of stiff plastic is provided for the filing case 10. The plastic tote box 54 has a rectilinear configuration of fixed dimensions and is formed with a back panel 56, a front panel 58, a bottom panel 60, and opposing side panels 62 and 64. The tote box 54 provides a convenient place for storing bulky articles, such as large catalogs, sales samples, and other documents and objects that cannot be conveniently filed in the pockets of a file folder.

The tote box 54 fits snugly into the rear pouch compartment 50 formed between the back wall 36, the compartment demarcation panel 48, the rear compartment side walls 44 and 46 and the bottom 34 of the base structure 12. When the tote box 54 is inserted into the rear pouch compartment 50 its surfaces reside in contact with the back wall 36, the compartment demarcation panel 48, the rear compartment side walls 44 and 46, and the bottom 34 of the base structure 12. With the tote box 54 inserted in it, the rear compartment 50 also has a rectilinear configuration of fixed dimensions corresponding to the outside dimensions of the tote box 54.

Alternatively, the tote box 54 may be removed from the rear pouch compartment 50 as illustrated in FIG. 9. Preferably, there are detachable fastening elements in the rear compartment and on the tote box 54 that releaseably hold the tote box 54 in the rear compartment 50. In the embodiment illustrated these detachable fastening elements are pads 66 of flexible, fabric hooks and mating pads 68 of flexible fabric looped pile. Mating pads of this type are sold under the registered trademark Velcro®. In the embodiment illustrated the pads 66 bearing the fabric hooks are secured to the sides 62 and 64 and to the back 56 of the tote box 54, near the upper edges thereof. The corresponding pads 68 of looped pile are permanently mounted on the inside surfaces of the fabric side walls 44 and 46 of the rear compartment 50 at locations so as to engage the pads 66 when the tote box 54 is fully seated in the rear compartment 50.

The use of detachable fastening elements, such as the interengageable pads 66 and 68 ensures that the tote box 54 will not inadvertently fall out of the rear compartment 50. When one desires to remove the tote box 54 from the rear compartment 50, the walls of the rear compartment 50 and the surfaces of the tote box 54 are flexed away from each other to peel the pads 66 apart from the pads 68. The tote box 54 can then be easily removed from the rear compartment 50 in the manner illustrated in FIG. 9.

The filing case 10 is further comprised of a pair of front compartment side panels 70 and 72 that are folded from top to bottom with a plurality of accordion folds and secured from top to bottom to the opposing side edges 51 of the compartment demarcation panel 48 and from top to bottom to the opposing side edges 28 of the front compartment front panel 26.

The filing case 10 is further comprised of a plurality of transverse, generally rectangular plastic front compartment divider sheets 74 that are each formed of a separate sheet of plastic. Each filing case section divider 74 has a generally rectangular configuration with a horizontal top edge 78 and a horizontal bottom edge 80. The top and bottom edges 78 and 80 are mutually parallel to each other throughout the greater part of their lengths. However, the ends of the top edge 78 may be scooped upwardly above the central portions of the divider sheet 74.

Indexing label tabs 86 may be heat welded at different locations along the transverse width of the large file section dividers 74. Each of the indexing tabs 86 is formed of a doubled over strip of plastic, the bottom edges of which are heat welded adjacent the top edges 78 of the filing case section dividers 74. Small gripping notches are provided at the opposing right edges of each tab 86 on one side thereof to facilitate separation of the two plies of plastic forming the tab 86 in order to insert thin paper labels therein. The file indexing tabs 86 thereby form a readily visible indexing system for the filing case 10 as is evident from FIG. 9.

Figure 14:
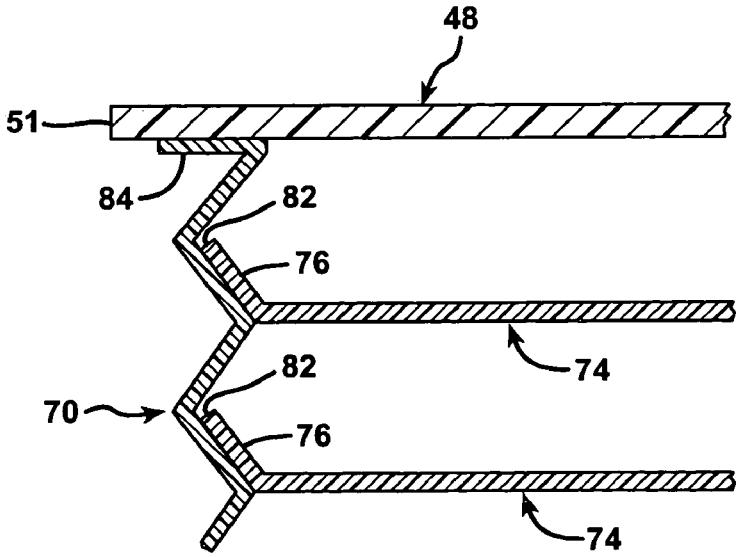
FIG. 14 is a sectional detail taken along the lines 14—14 of FIG. 12.

Each filing case section divider 74 also has mutually parallel side edges 82 which are oriented perpendicular to the filing case divider upper and lower edges 78 and 80. As illustrated in FIG. 14, each of the filing case section dividers 74 is folded at its transverse ends to form side edge margin strips 76, which are narrow, elongated strips and which extend the entire height of the filing case section dividers 74 at the side edges 82 thereof.

The side edge margins 76 of the filing case section dividers 74 are heat welded to the front compartment side panel sheets 70 and 72 throughout between the upper and lower divider edges 78 and 80 of the filing case section dividers 74, as best illustrated in FIGS. 7 and 14. The side edges 82 of the filing case section dividers 74 are thereby coupled to the filing case front cover 26 and to the filing case compartment demarcation panel 48 with a plurality of accordion fold pleated connections formed by the front compartment side panels 70 and 72. The opposing end margins 84 of the front compartment side panel sheets 70 and 72 are folded to reside in intimate contact with the mutually facing surfaces of the compartment demarcation panel 48 and the front panel 26, and are sonic welded thereto from top to bottom, also as illustrated in FIG. 14.

Figure 8:
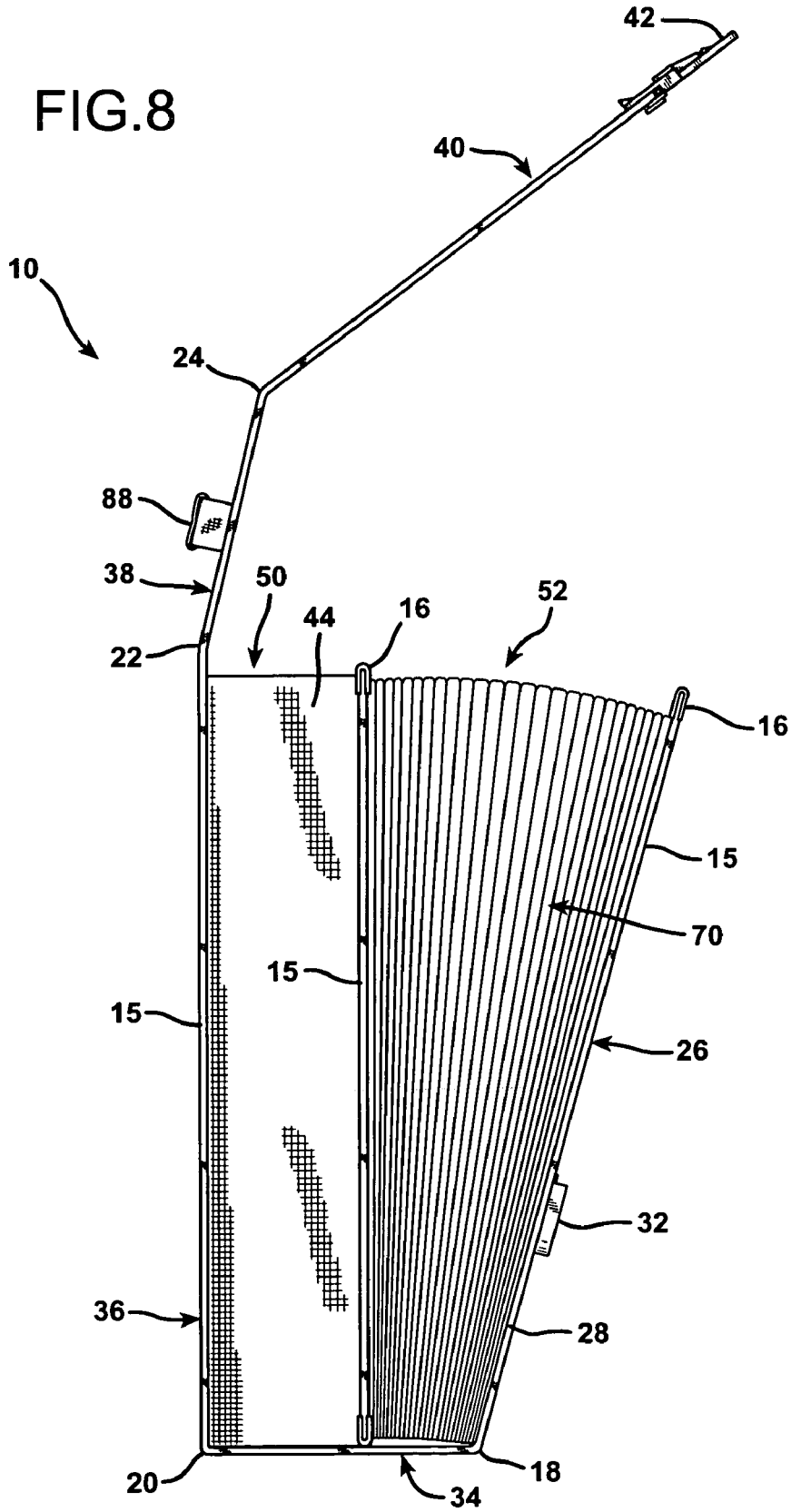
FIG. 8 is a left side elevational view thereof taken along the lines 8—8 of FIG. 7.

A plurality of filing folder file pockets are formed between the filing folder file section dividers 74, the filing folder front cover 26, and the compartment demarcation panel 48. The portion of the filing case 10 from the compartment demarcation panel 48 to the filing folder front cover 26 may be considered to be a front compartment or an expandable filing folder 52. As illustrated in FIGS. 8 and 10, the filing folder 52 may be expanded by drawing the upper edge of the filing folder front cover 26 out away from the compartment demarcation panel 48, thereby fanning the filing folder file section dividers 74 apart to enlarge the openings of the filing folder file pockets defined in the filing folder 52 between the upper edges 78 of the filing case section divider sheets 74. This facilitates insertion and removal of papers into and from the filing folder pockets. The expandable filing folder 52 can only be expanded in this way when the clasp elements 32 and 42 are disengaged. The filing folder pockets are only accessible when the covering flap 40 has been lifted, as illustrated in FIGS. 7–11 and 12.

The filing case 10 may be utilized either with or without the tote box 54 inserted into the rear compartment 50. FIG. 10 illustrates the use of the filing case 10 with the tote box 54 inserted into the rear compartment 50 and with the covering flap 40 raised, as more fully illustrated in FIG. 8. When the filing case 10 is utilized in this manner the upper edge of the filing folder front cover 26 may be drawn forwardly away from the rear compartment 50 for access to the filing folder file pockets in the expandable front compartment 52. Catalogs and other bulky articles may be concurrently placed into or removed from the tote box 54 in the rear compartment 50.

Figure 11:
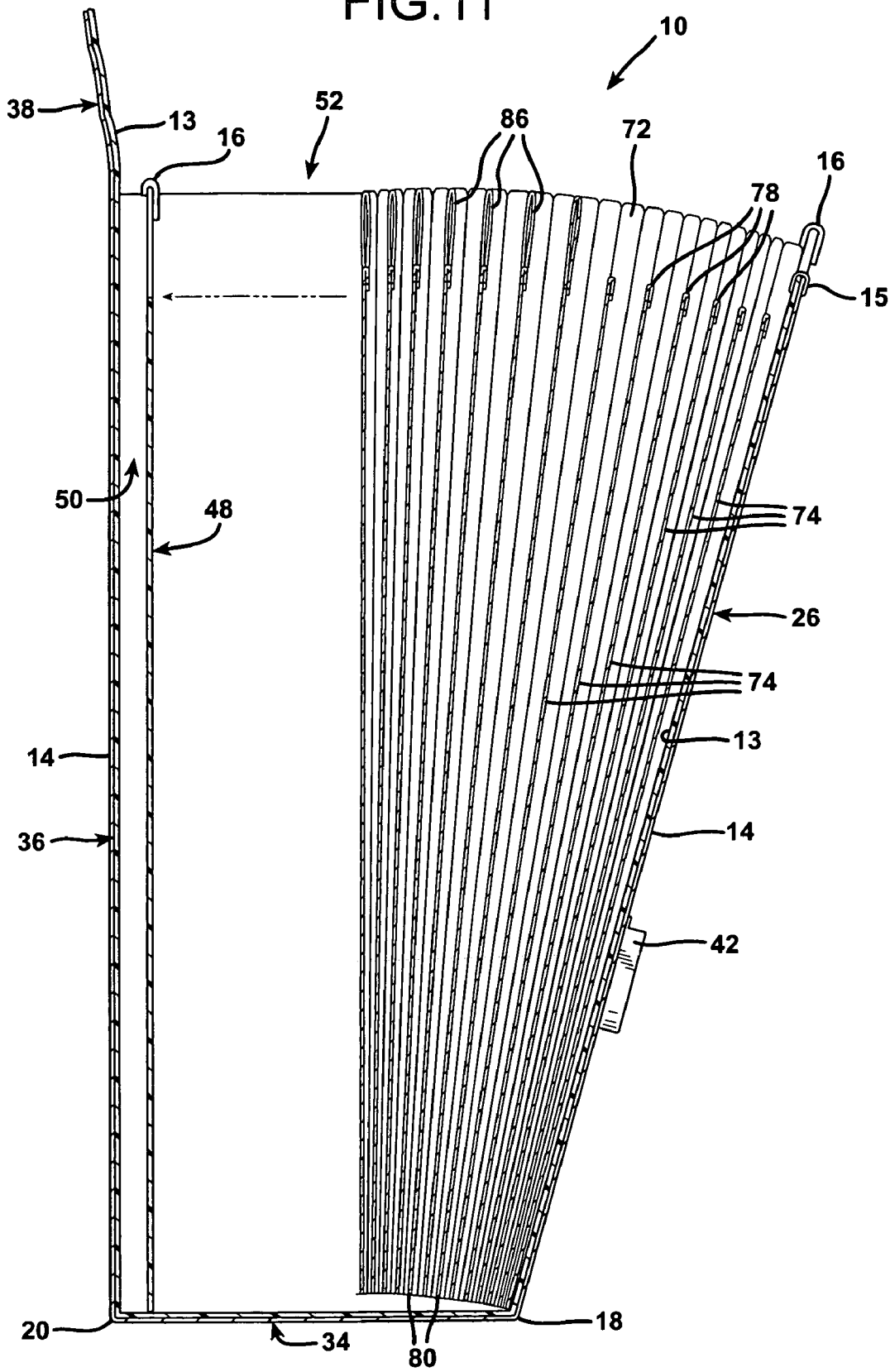
FIG. 11 is a side sectional elevational view thereof shown with the tote box removed and with the filing folder expanded rearwardly thereby expanding the volume of space occupied by the front compartment and reducing the volume of space occupied by the rear compartment.

Sometimes there is a greater need for more filing folder pocket space in the front compartment 52 and less of a need for storing bulky articles. In such situations the tote box 54 may be removed from the rear compartment 50, as illustrated in FIG. 9. Since the fabric compartment sidewalls 44 and 46 are formed of a flexible, fabric material, the compartment demarcation panel 48 may then be pushed rearwardly toward or even into contact with the pouch back cover 36, as illustrated in FIG. 11. This allows the filing folder file section dividers 74 to be spread apart even further for greater storage volume in the front compartment 52 and for greater ease of access to the individual filing folder pockets defined between the file section dividers 74 and between the filing folder front cover 26 and the compartment demarcation panel 48.

Figure 1:
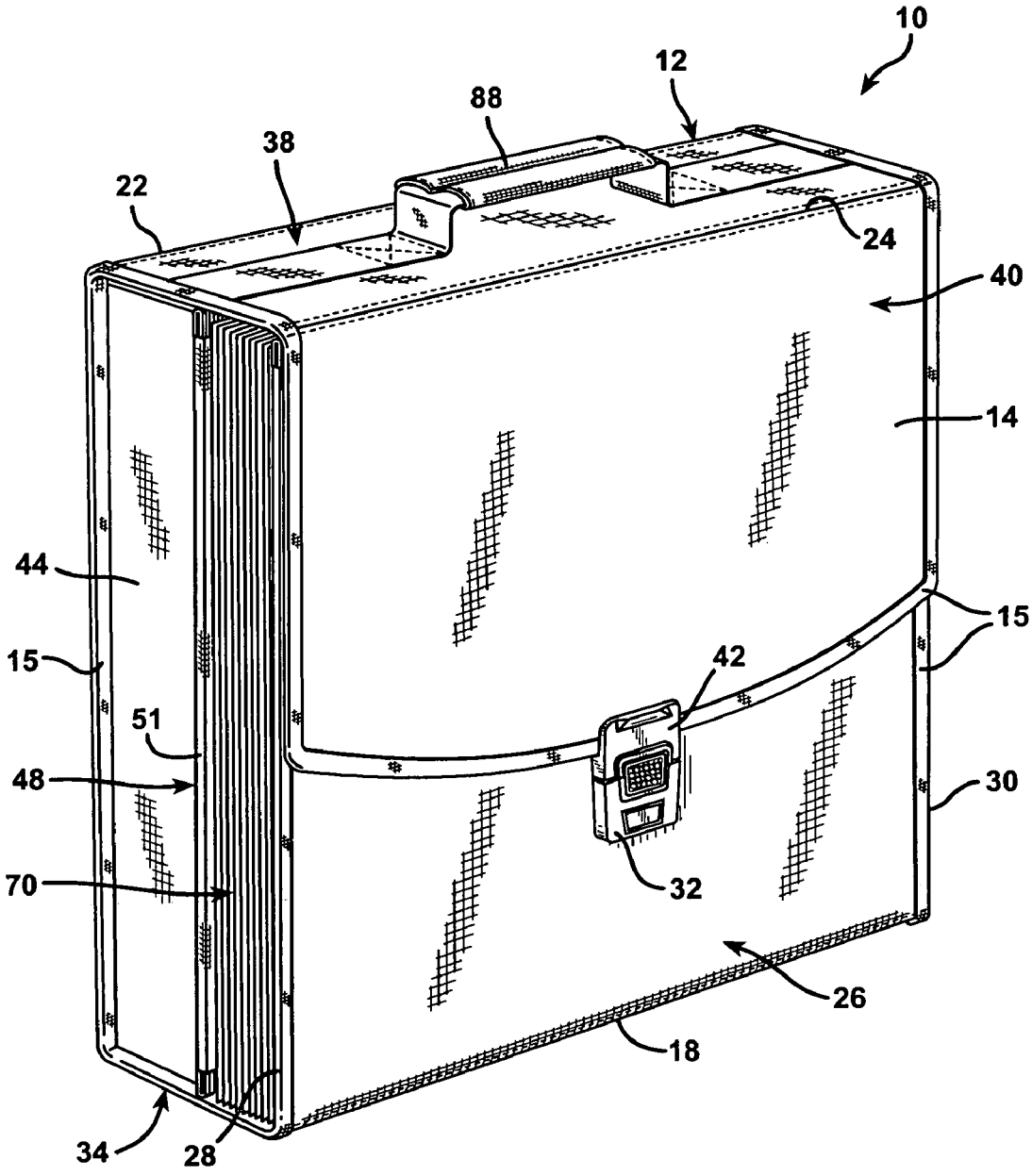
FIG. 1 is a perspective view of one embodiment of an expanding filed with the removable tote box according to the invention, shown with the foldable covering flap closed and the clasp elements engaged.
Figure 2:
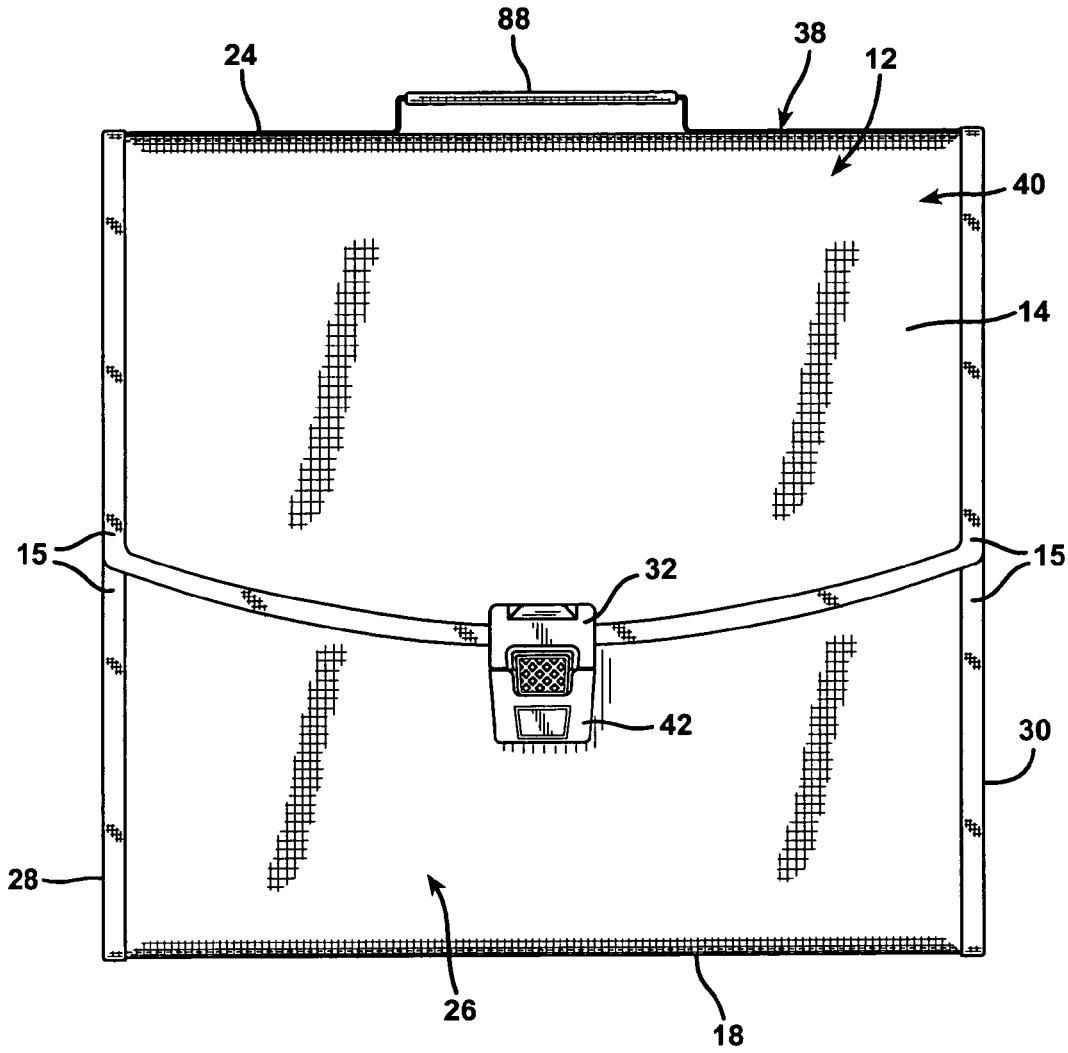
FIG. 2 is a front elevational view of the embodiment of the invention shown in FIG. 1.
Figure 3:
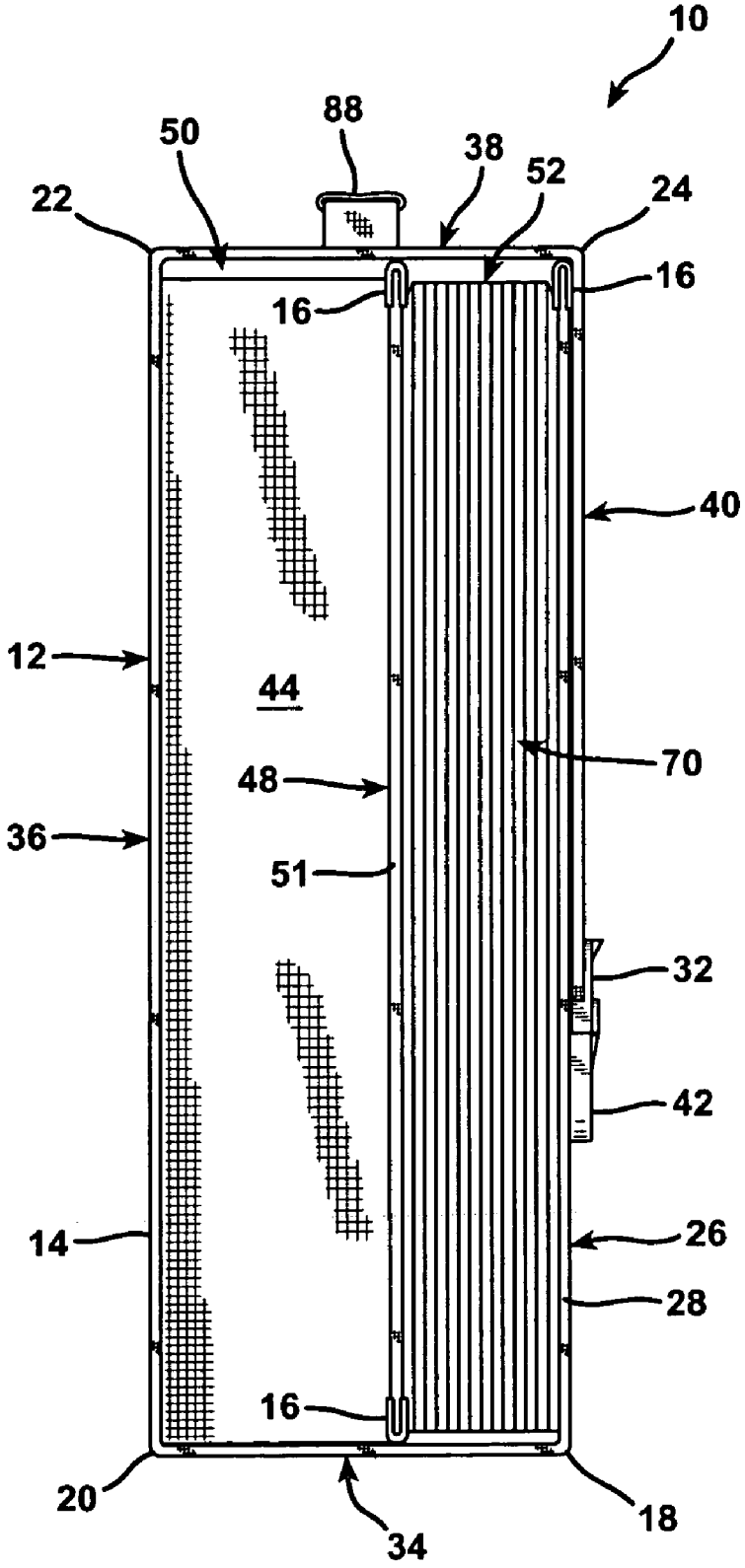
FIG. 3 is a left side elevational view thereof.
Figure 4:
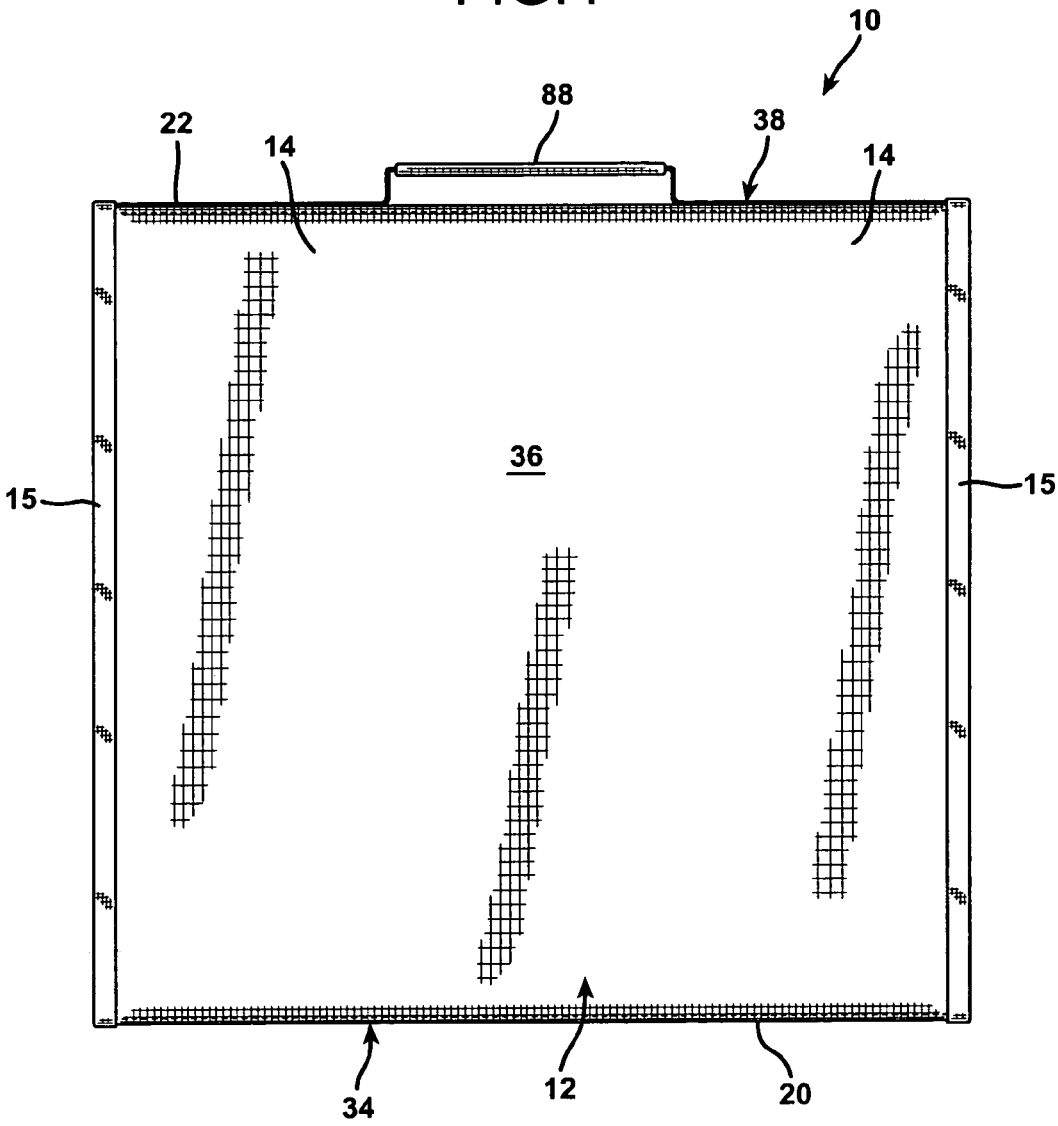
FIG. 4 is a rear elevational view thereof.
Figure 5:
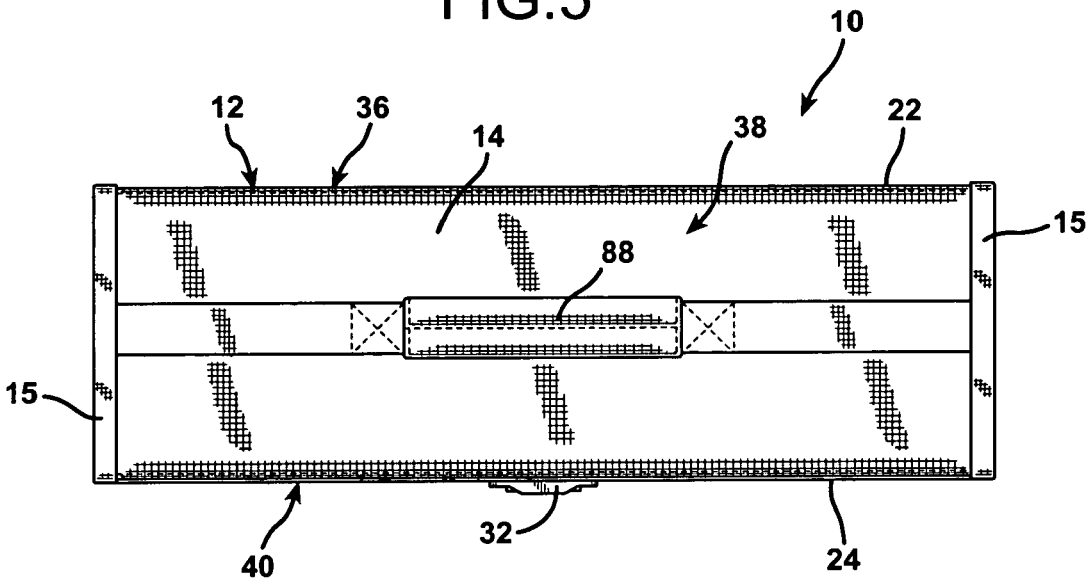
FIG. 5 is a top plan view thereof.
Figure 6:
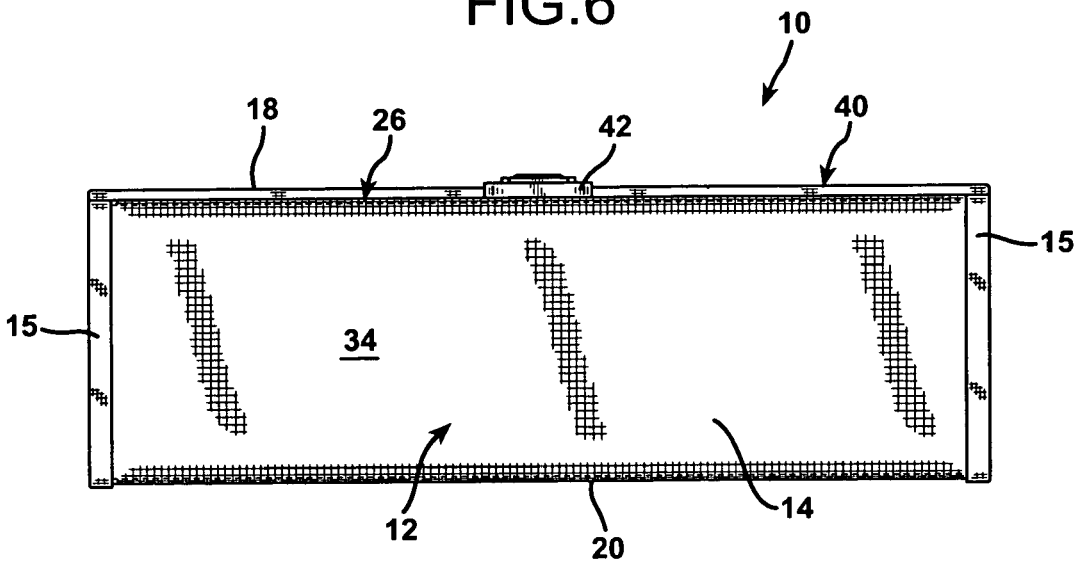
FIG. 6 is a bottom plan view thereof.

To transport the filing case 10, the expandable file folder front compartment 52 is normally collapsed by pushing the upper edge of the filing folder front cover 26 rearwardly, toward the compartment demarcation panel 48 to collapse the pockets therebetween to the extent permitted by the documents contained therein. The foldable flap 40 is then brought forward so that the top 38 of the base structure 12 resides in a generally horizontal disposition, closing both the expandable front compartment 52 and the rear compartment 50. This may be done either with the tote box 54 in the rear compartment 50, as illustrated in FIG. 3, or with the tote box 54 removed from the rear compartment 50.

In either case the foldable flap 40 is brought down to overlap the upper edge of the front compartment front panel 26, and the tongue of the second clasp element or member 42 is inserted into a corresponding socket of the first clasp element 32 and snaps into latching engagement therewith. The filing case 10 is then closed and ready for transport with the contents fully encapsulated and constrained therewithin.

Preferably, the top 38 of the base structure 12 is provided with a conventional grip 88 formed by a strip of fabric extending transversely across the central region of the top 38. The ends of the fabric strip are sewn to the top 38 at a transversely spaced distance apart from each other. The grip 88 thereby is formed with a loop which can be grasped by the fingers of one hand of a user.

Figure 13:
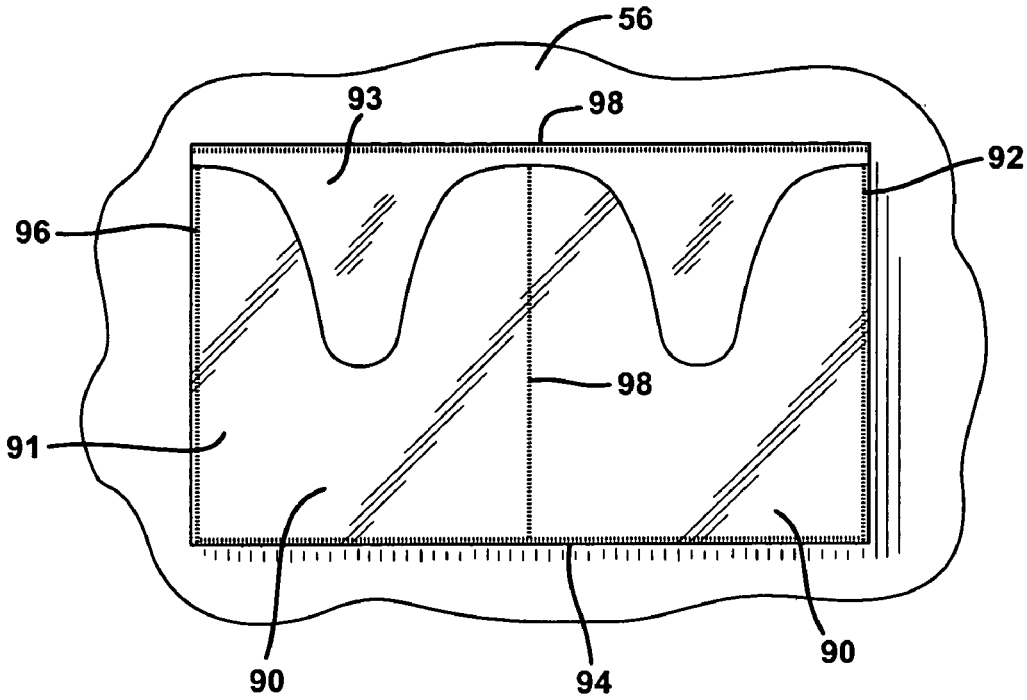
FIG. 13 is a front elevational detail illustrating a pair of hanging pockets attached to the inside of the tote box and taken along the lines 13—13 in FIG. 10.

The filing case 10 may be provided with various optional features. For example, and as illustrated in FIG. 13, the filing case 10 may be provided with at least one and preferably a pair of hanging pockets 90. The hanging pockets 90 may be configured of a size and shape suitable to snugly receive a portable computer data storage disk therewithin, either a floppy disk or a CD or DVD disk. The hanging pockets 90 may be created from a pair of sheets of flexible plastic material each welded to each other along three edges, as indicated by the heat weld seams 92, 94, and 96. A central, dividing heat weld 98 between the two sheets of plastic material delineates the hanging pockets 90 from each other. The upper edge of the exposed sheet of material 91 is not heat sealed to the rear sheet 93. To the contrary, the upper edge of the front sheet 91 is scooped out at each of the pockets 90 to facilitate insertion and removal of computer disks into and from the pockets 90. The upper edge of the rear plastic sheet 93 is secured by a transversely extending heat seal 98 to the back wall 56 of the tote box 54. The lower edges of the pockets 90 are thereby free swinging relative to the tote box 54.

Figure 12:
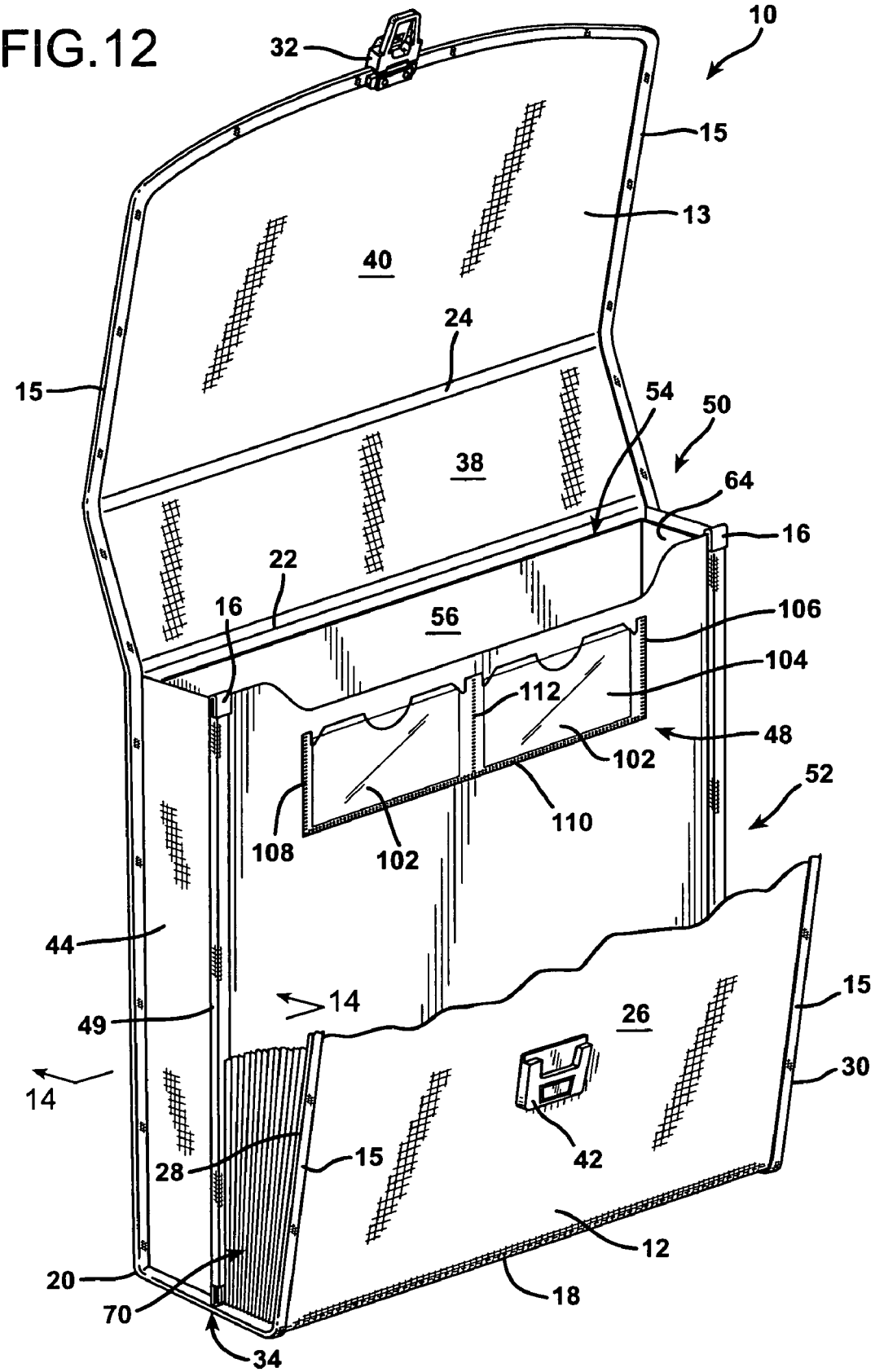
FIG. 12 is a perspective view of the embodiment of the filing case illustrated in an open condition and shown with the filing folder partially broken away.

Also, as illustrated in FIG. 12, the compartment divider 48 may be provided with at least one, and preferably a pair, of window pockets 102 secured to the compartment divider panel 48 and facing the front compartment file divider sheets 74. Preferably, the window pockets 102 are configured in a size and shape suitable for receiving business cards. The pockets 102 are formed of a single sheet of thin plastic material 104 that is heat sealed to the forwardly facing surface of the compartment divider panel 48 about its lateral side edges 106 and its lower edge 110. A central, vertical heat seal 112 divides the window pockets 102 from each other. The window pockets 112 are thereby closed on their side and bottom edges and the business cards or other small papers may be inserted into them from the top.

Undoubtedly, numerous variations and modifications of the invention will become readily apparent to those familiar with office supplies and expanding files. Accordingly, the scope of the invention should not be construed as limited to the specific embodiment depicted and described, but rather is defined in the claims appended hereto.

I claim:

1. A filing case comprising, a filing pouch having a stiff compartment demarcation panel and a stiff pouch back cover both having upper and lower edges and said compartment demarcation panel is located in front of said pouch back cover, and a stiff folding flap joined to said upper edge of said pouch back cover in articulated fashion, a pair of flexible pouch side panels each having upper and lower edges and each being attached to said compartment demarcation panel and said pouch back cover from said upper edges to said lower edges thereof, and a stiff pouch bottom panel extending transversely between said pouch side panels and between said compartment demarcation panel and said pouch back cover, whereby said filing pouch forms a pouch compartment between said compartment demarcation panel, said pouch back cover, said pair of pouch side panels, and said pouch bottom panel, a stiff tote box of fixed dimensions formed with a back panel, a front panel, a bottom panel, and opposing side panels, and said tote box snugly fits into said pouch compartment, and said tote box is alternatively removable from said pouch compartment and insertable into said pouch compartment pocket to contact said pouch back cover, said compartment demarcation panel, said bottom panel, and said pouch side panels, and an expandable filing folder having a filing folder front cover having a top and a bottom and a first clasp member thereon and wherein said compartment demarcation panel forms a back for said expandable filing folder, and said filing folder has a plurality of filing folder file section dividers having opposing, mutually parallel filing folder divider, upper and lower edges and opposing, mutually parallel filing folder divider side edges oriented perpendicular to said filing folder divider upper and lower edges and coupled to said filing folder front cover and said compartment demarcation panel with a plurality of accordion folding pleated connections, thereby forming a plurality of filing folder file pockets between said filing folder file section dividers and said filing folder front cover and said compartment demarcation panel, and wherein said folding flap has a second clasp member thereon and is foldable over said filing folder front cover and over said expandable filing folder to both close said pouch compartment and envelop said filing folder between said folding flap and said pouch back cover, whereupon said first and second clasp members are engageable with each other, both when said tote box is inserted into said pouch compartment and when said tote box is removed therefrom, and said folding flap is unfoldable to expose both said pouch compartment and said expandable filing folder.

2. A filing case according to claim 1 further comprising a pair of plastic filing folder side panel sheets folded from top to bottom with a plurality of accordion folds and having fore and aft edge strips from top to bottom secured to said filing folder front cover and to said demarcation panel, respectively, and said filing folder section dividers are formed as plastic sheets all having side edge margins adjacent said side filing folder divider edges, and said filing folder divider section side edge margins are heat welded to separate ones of said accordion folds of said filing folder side panel sheets from top to bottom between said upper and lower filing folder divider edges, thereby forming said plurality of accordion folding pleated connections.

3. A filing case according to claim 1 wherein said tote box is equipped with a first set of releaseable fastening elements and said filing pouch is equipped with a second set of releaseable fastening elements, and said first and second sets of releaseable fastening elements are mutually engageable together and disengageable from each other.

4. A filing case according to claim 3 wherein said first and second sets of releaseable fastening elements are comprised of mating pads of flexible, fabric hook and loop fastener material.

5. A filing case according to claim 1 further comprising at least one hanging pocket permanently secured inside said tote box near the upper extremity thereof.

6. A filing case according to claim 5 wherein said at least one hanging pocket is configured in size and shape to snugly accommodate a portable computer disk.

7. A filing case according to claim 1 further comprising at least one transparent window pocket formed into said expandable filing folder on said compartment demarcation panel.

8. A filing case having a rear compartment and an expandable front compartment with a stiff compartment demarcation panel located therebetween, and a plurality of file section dividers located in said expandable front compartment to divide said expandable front compartment into separate pockets between said file section dividers, and said file section dividers have side edge margins, and further comprising a pair of front compartment side panels folded from top to bottom with a plurality of accordion folds, and said side edge margins of said file section dividers are individually secured to said side panels at separate ones of said accordion folds, so that said front compartment is collapsible front to back, and said rear compartment is formed by a stiff back wall located behind said compartment demarcation panel, and said rear compartment has flexible side walls extending from said back wall to said compartment demarcation panel, whereby said rear compartment is configured as a cavity located between said compartment demarcation panel, said back wall and said rear compartment side walls, and further comprising a stiff, rectilinear tote box removably insertable into said rear compartment to fit snugly between said back wall, said compartment demarcation panel and said rear compartment side walls in contact therewith, and further comprising a releaseable folding cover flap projecting upwardly from said back wall and foldable forwardly to extend over both said front and rear compartments, and releaseable, mutually engageable clasp elements are provided on said folding cover flap and on said front panel of said front compartment.

9. A filing case according to claim 8 wherein said front compartment side panels are formed of plastic sheets and said file section dividers are also formed of plastic sheets, and said side edge margins of said file section dividers are heat welded to said front compartment side panels.

10. A filing case according to claim 8 further comprising detachable fastening elements in said rear compartment and on said tote box that releaseably hold said tote box in said rear compartment.

11. A filing case according to claim 10 wherein said detachable fastening elements are mating flexible pads of flexible, fabric hooks and flexible fabric looped pile.

12. A filing case according to claim 8 further comprising at least one hanging pocket secured within said tote box.

13. A filing case comprising:

a stiff, flat base structure divided transversely by folds to define articulated components including a front compartment front panel having opposing side edges and a first clasp element thereon, a bottom, a back wall, a top cover closure flap having a second clasp element thereon, and said articulated components are joined together by transverse hinge connections, a pair of flexible rear compartment side panels extending forwardly from said back wall and located atop said bottom, a transversely oriented stiff compartment demarcation panel located in front of said back wall and above said bottom and extending between and joined to said rear compartment side panels, and having opposing side edges joined to said rear compartment side panels, thereby delineating a rear compartment from a front compartment, a stiff, rectilinear tote box that snugly fits into said rear compartment and is removable therefrom, and a pair of front compartment side panels folded from top to bottom with a plurality of accordion folds and secured from top to bottom to said opposing side edges of said compartment demarcation panel and from top to bottom to said opposing side edges of said front compartment front panel, and a plurality of transverse front compartment divider sheets having side edge margins than are individually secured to separate ones of said accordion folds in said front compartment side panels to thereby define a plurality of transversely extending pockets in said front compartment closed from beneath by said bottom, whereby said front compartment is compressible by rotation of said front compartment front panel relative to said bottom and toward said compartment demarcation panel and expandable by rotation of said front compartment front panel relative to said bottom away from said compartment demarcation panel when said, clasp elements are disengaged, and said cover flap may be closed and said clasp elements engaged together when said front compartment is collapsed, both with and without said tote box in said rear compartment.

14. A filing case according to claim 13 further comprising releaseable fastening members for holding said tote box in said rear compartment.

15. A filing case according to claim 14 further comprising at least one hanging pocket configured to receive a portable computer data storage disk therewithin.

16. A filing case according to claim 13 further comprising at least one window pocket secured to said compartment divider and facing said front compartment file divider sheets.

* * * * *